US006275134B1

(12) United States Patent
Chen

(10) Patent No.: US 6,275,134 B1
(45) Date of Patent: Aug. 14, 2001

(54) SAFETY SWITCH WITH A ROCKER TYPE ACTUATOR AND TRIP-OFF CONTACT

(76) Inventor: Tsan-Chi Chen, 8F, No. 120-11, Chungshan Rd., Sec. 3, Chung Ho City, Taipei Hsien (TW)

( * ) Notice: Subject to any disclaimer, the term of this patent is extended or adjusted under 35 U.S.C. 154(b) by 0 days.

(21) Appl. No.: 09/516,228

(22) Filed: Mar. 1, 2000

(51) Int. Cl.[7] ..... H01H 61/00; H01H 71/14
(52) U.S. Cl. ..... 337/37; 337/85; 337/94
(58) Field of Search ..... 337/36, 37, 52, 337/57, 58, 65, 66, 67, 68, 85, 94; 200/553, 339, 402–472

(56) References Cited

U.S. PATENT DOCUMENTS 4,167,720 * 9/1979 Krasser ..... 337/60
4,528,538 * 7/1985 Andersen ..... 337/43
5,223,813 * 6/1993 Cambreleng et al. ..... 337/66
5,491,460 * 2/1996 Krasser et al. ..... 337/70
5,742,219 * 4/1998 Moalem et al. ..... 337/68
6,072,381 * 6/2000 Yu ..... 337/37
6,094,126 * 7/2000 Sorenson ..... 337/37

* cited by examiner

*Primary Examiner*—J. R. Scott
(74) *Attorney, Agent, or Firm*—Bacon & Thomas PLLC

(57) ABSTRACT

A safety switch. The switch includes a housing configured to hold a pivoted lever at the top and three metal contact plates at the bottom. A movable member pivots on the intermediate metal contact plate. A bimetal element with a fixed end is connected to one end of the movable member and a free end of the bimetal element is suspended above one of the lateral metal contact plates. An actuating member is coupled between the lever and the movable member and driven by the lever to tilt the movable member between a first position where the free end of the bimetal element is forced into contact with the corresponding lateral metal contact plate, causing the circuit to be closed, and a second position where the free end of the bimetal element is disconnected from the corresponding lateral metal contact plate, causing the circuit to be opened. The lever can include a light, a conductive end of which contacts the remaining lateral metal contact. The bimetal element can be heated to curve and to trip off upon an overload after the movable member has been moved to the first position.

6 Claims, 5 Drawing Sheets

SAFETY SWITCH WITH A ROCKER TYPE ACTUATOR AND TRIP-OFF CONTACT

BACKGROUND OF THE INVENTION

1. Field of the Invention

The present invention relates to a durable safety switch, which automatically trips off upon an overload.

2. Description of the Related Art

FIG. 1 shows a regular switch, which comprises an electrically insulative housing 100, three metal contact plates 110*a–c* fastened to the bottom sidewall 101 of the housing 100, a lever 120 disposed at the topside of the housing 100, a neon light 130 mounted in the lever 120, the neon light 130 having a first end disposed corresponding to one lateral metal contact plate 110*c* and a second end, a metal frame 150 coupled to the middle metal contact plate 110*b*, the metal frame 150 having a contact 151 aimed at a contact 111 at one lateral metal contact plate 110*a*, and a metal spring 140 connected between the metal frame 150 and the second end of the neon light 130. When one end of the lever 120 is depressed, the first end of the neon light 130 is forced into contact with the corresponding lateral metal contact plate 110*a*, and at the same time the spring 140 is compressed to force the metal frame 150 to tile in direction reversed to the lever 120, thereby causing the contact 151 of the metal frame 150 to be forced into contact with the contact 111 at the other lateral metal contact plate 110*a*, and therefore the circuit is closed. When the other end of the lever 120 is depressed, the neon light 130 is disconnected from the corresponding lateral metal contact plate 110*c*, and the metal frame 150 is tilted in the reversed direction and disconnected from the other lateral metal contact plate 110*b* to open the circuit. This structure of switch is not safe in use. In case of an overload when the circuit is closed, the metal frame 150 does not automatically trip off to open the circuit, and the load may be burnt out. FIG. 2 shows another conventional safety switch. This structure of safety switch comprises an electrically insulative housing 200, three metal contact plates 220*a–c* fastened to the bottom side of the housing 200, a lever 210 pivoted to the housing 200 at the top side, a metal frame 230 fixedly fastened to the middle metal contact plate 220*b*, a bimetal element 240 having a first end fastened to the top side of the metal frame 230 and a second end, a C-shaped spring 241 having one end pivoted to the second end of the bimetal element 240 and an opposite end connected to the bottom side of the metal frame 220, a first contact 242 disposed at the bimetal element 240, and a second contact 221 disposed at one lateral metal contact plate 220*c* adjacent to the first contact 242. When an overload occurs, the bimetal element 240 is heated and disengages from contact with the contact 221 of the metal contact plate 220*c* trip to cut off the power supply. This structure of switch is safe in use. However, this structure of safety switch is not durable because the bimetal element 240 breaks quickly with repeated use.

SUMMARY OF THE INVENTION

According to one aspect of the present invention, the safety switch comprises a housing holding a pivoted lever at the top and three metal contact plates at the bottom, a movable member pivoted to the intermediate metal contact plate, a bimetal element having a fixed end connected to one end of the movable member and a free end suspended above one lateral metal contact plate, an actuating member coupled between the lever and the movable member and driven by the lever to tilt the movable member between the first position where the free end of the bimetal element is forced into contact with the corresponding lateral metal contact plate, causing the circuit to be closed, and a second position where the free end of the bimetal element is disconnected from the corresponding lateral metal contact plate, causing the circuit to be opened, the bimetal element being heated to curve and to trip off upon an overload after the movable member has been moved to the first position. Because the bimetal element is horizontally extended and moved with the movable member, it is never stretched when the lever is operated. According to another aspect of the present invention, an adjustment member is mounted on the closed bottom side of the housing for adjusting the turning angle of the movable member on the second metal contact plate to control the trip off time of the bimetal element.

BRIEF DESCRIPTION OF THE DRAWINGS

FIG. 4 is an applied view of the present invention showing the safety switch switched on.

DETAILED DESCRIPTION OF THE PREFERRED EMBODIMENT

Figure 1:
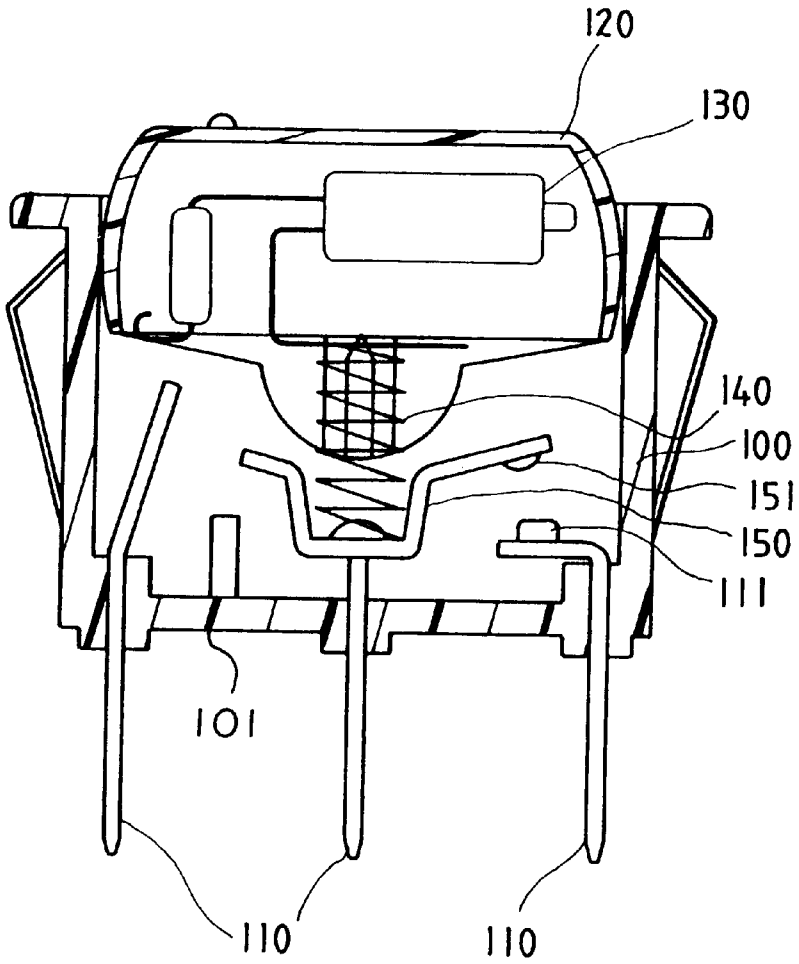
Fig. 1 PRIOR ART
FIG. 1 illustrates the arrangement of a switch according to the prior art.
Figure 2:
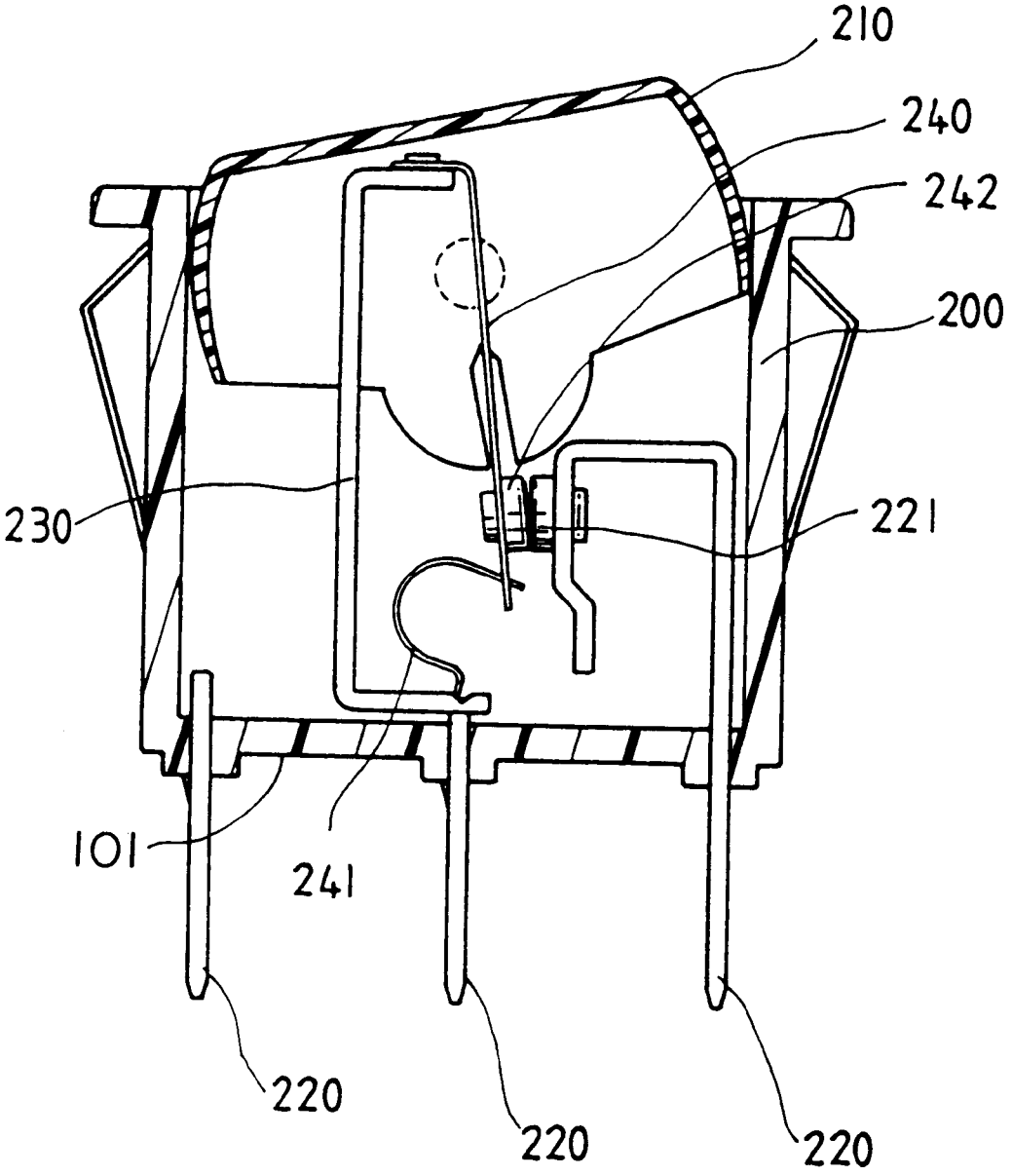
Fig. 2 PRIOR ART
FIG. 2 illustrates the arrangement of a safety switch according to the prior art.
Figure 3:
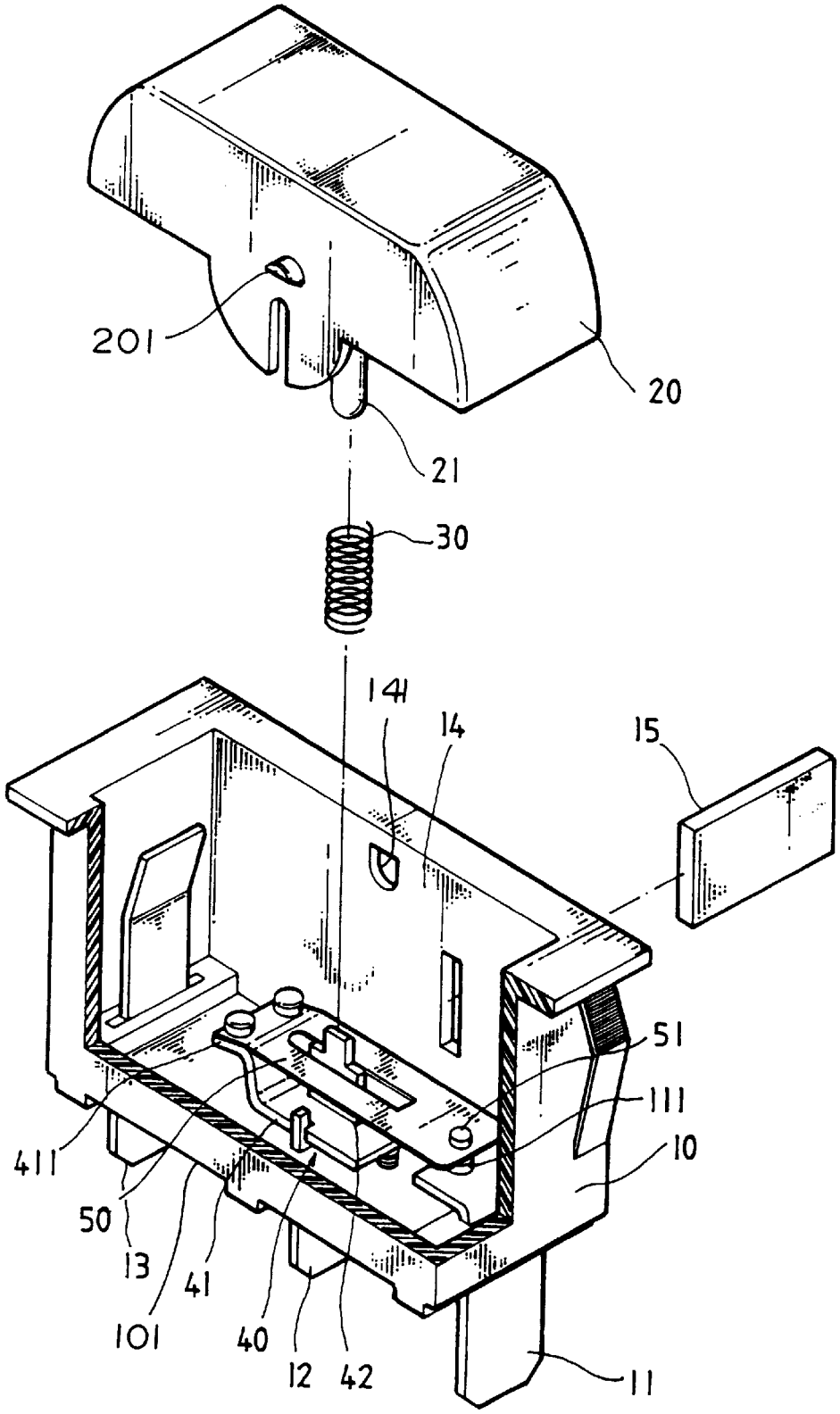
FIG. 3 is an exploded view of a safety switch according to the present invention with a portion of the housing cut out.
Figure 4:
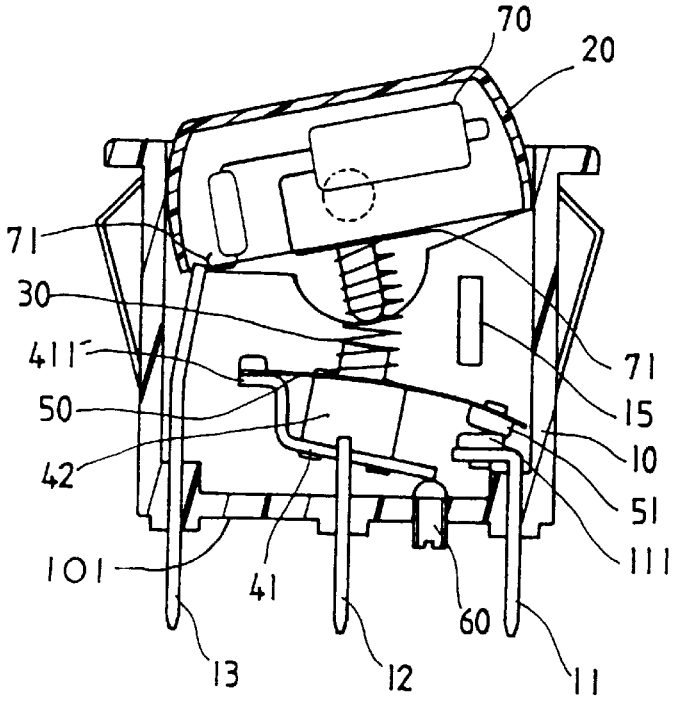

Referring to FIGS. 3 and 4, a safety switch according to the present invention automatically trips off when an overload occurs. The safety switch comprises an electrically insulative housing 10 shaped like a top-open container, the housing having a top opening 14, three metal contact plates, namely, the first metal contact plate 11, the second metal contact plate 12 and the third metal contact plate 13 respectively fastened to the bottom side 101 of the housing 10 and extended to the outside of the housing 10, a lever 20 pivoted to the housing 10 and suspended in the top opening 14 of the housing 10, the lever 20 having a bottom projection 21, a metal movable member 40 pivoted to the second metal contact plate 12, a support 42 mounted on the base 41 of the movable member 40, and a metal actuating member, for example, a metal spring 30 having a top end connected to the bottom projection 21 of the lever 20 and a bottom end connected to the support 42 at the movable member 40. A pivot projection 201 projects from each of the lateral sides of the lever 20, and the pivot projections 201 are housed in corresponding pivot holes 141 of the insulative housing 10, as shown in FIG. 3. The base 41 of the movable member 40 comprises a bearing portion 411 at one end. A slightly smoothly arched, horizontally extended trip-off element 50 is provided having one end, namely, the fixed end fixedly connected to the bearing portion 411 of the base 41 of the movable member 40 and an opposite end, namely, the free end provided with a contact 51 aimed at the contact at the first metal contact plate 11. The trip-off element 50 is a bimetal element, which curves in one direction when heated. The movable member 40 is tilted back and forth following the operation of the lever 20, causing the bimetal trip-off element 50 to be moved with the base 41 of the movable member 40 between the first position where the contact 51 at the bimetal clement 50 is disposed in contact with the contact 111 at the first metal contact plate 11, and the second position where the contact 51 at the bimetal element 50 is disconnected from the contact 111 at the first metal contact plate 11. Because the bimetal element 50 is smoothly arched, it is heated to curve in the reversed direction and to move the contact 51 away from the contact 111 at the first metal contact plate 11 upon an overload (see FIG. 5). Because the bimetal element 50 moves with movable member 40, it is never stretched. Therefore, the bimetal element 50 does not break during the operation of the safety switch.

Referring to FIGS. 3 and 4 again, an adjustment element, for example, an adjustment screw 60 is threaded into a screw hole (not shown) on the bottom sidewall of the housing 10 and stopped at the free end of the movable member 40. Rotating the adjustment screw 60 forwards/backwards adjusts the oscillating range of the movable member 40, and the trip-off critical point of the safety switch is relatively adjusted.

Figure 5:
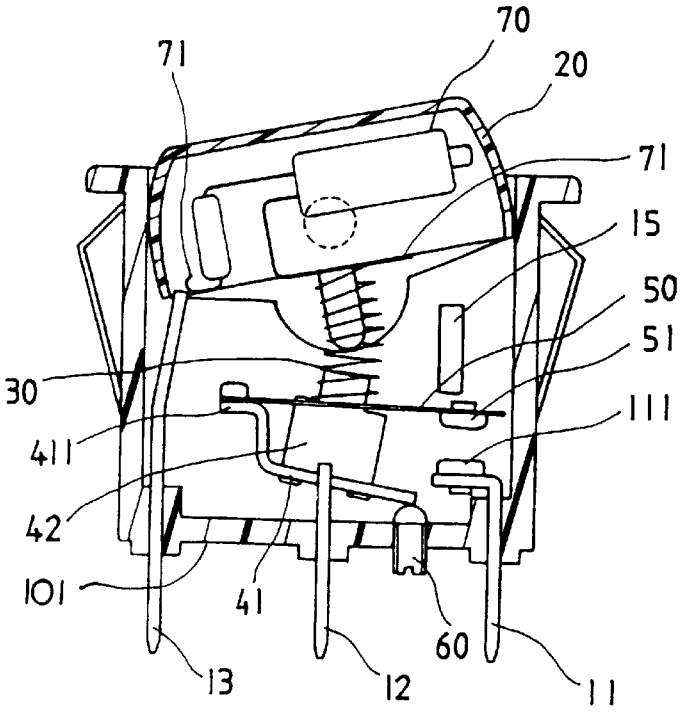
FIG. 5 is another applied view of the present invention showing the bimetal element tripped off upon an overload.
Figure 6:
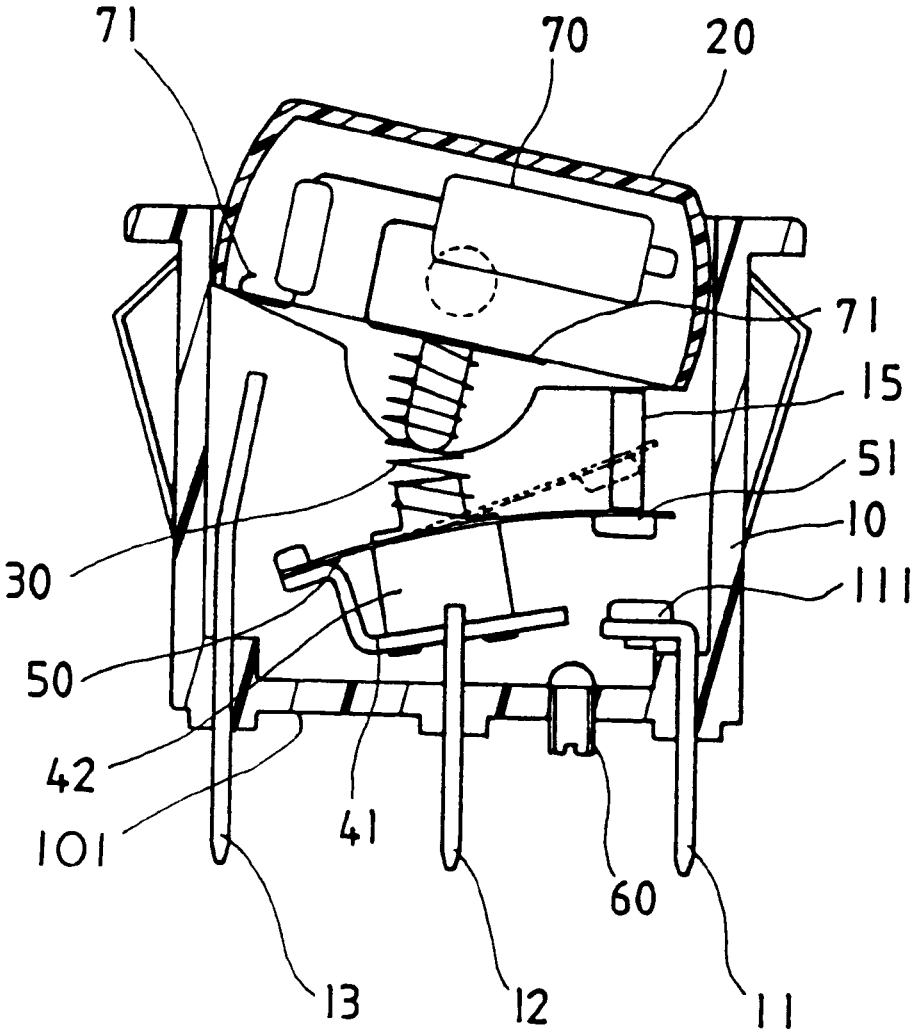
FIG. 6 is still another applied view of the present invention showing the safety switch switched off.

Referring to FIGS. 5 and 6 and FIGS. 3 and 4 again, a light emitting element, for example, a neon light 70 is mounted in the lever 20, having two lead-out wires 71 at two opposite terminals thereof. The lead-out wires 71 of the neon light 70 are respectively connected to the metal spring 30 and the third metal contact plate 13. When the lever 20 is depressed and tilted in one direction to switch on the safety switch, one lead-out wire 71 is electrically connected to the third metal contact plate 13, and the other lead-out wire 71 is electrically connected to the second metal contact plate 12 and the first metal contact plate 11 to close the circuit, and hence the neon light 70 is turned on (see FIG. 4). On the contrary, when the lever 20 is depressed and tilted in the reversed direction to switch off the safety switch, the bimetal element 50 is moved with the movable member 40 and disconnected from the contact 111 at the first metal contact plate 11, and therefore the circuit is opened, and the neon light 70 is off (see FIG. 6).

Referring to Figures from 3 through 6 again, a stop member, for example, a stop plate 15 is fixedly mounted inside the housing 10 and spaced above the free end of the bimetal element 50. When the bimetal element 50 trips off, the free end of the bimetal element 50 is stopped at the stop plate 15, thereby causing the bimetal element 50 to curve in one direction (see FIG. 6). Further, when the lever 20 is depressed and tilted in one direction to switch on the safety switch, one end, namely, the front end of the lever 20 is stopped above the third metal contact plate 13 (see FIG. 4). On the contrary, when the lever 20 is depressed and tilted in the reversed direction to switch off the safety switch, the other end, namely, the rear end of the lever 20 is stopped above the stop plate 15 (see FIG. 6). Therefore, the titling angle of the lever 20 is limited.

The safety switch can be used with a current-limit protective means in an extension cable, power switch, power socket, etc. When in use, as illustrated in FIG. 4, the first metal contact plate 11 is connected to power source at the extension cable, the second metal contact plate 12 is connected to the positive terminal of the extension cable, and the third metal contact plate 13 is connected to the negative terminal of the extension cable. When the lever 20 is depressed and tilted in one direction to switch on the safety switch, one lead-out wire 71 of the neon light 70 is moved with the lever 20 and forced into contact with the third metal contact plate 13, at the same time the metal spring 30 is driven to move the support 42, causing the bimetal element 50 and the movable member 40 to be tilted in one direction, and therefore the contact 51 at the free end of the bimetal element 50 is forced into contact with the contact 111 at the first metal contact plate 11 to electrically connect the first metal contact plate 11 and the second metal contact plate 12. Because one lead-out-wire 71 of the neon light 70 is disposed in contact with the third metal contact plate 13 at this time, the neon light is turned on when the first metal contact plate 11 and the second metal contact plate 12 are electrically connected (see FIG. 4). On the contrary, when the lever 20 is depressed and tilted in the reversed direction, the contact 51 is moved with the bimetal element 50 and disconnected from the contact 111 at the first metal contact plate 11, causing the neon light 70 to be turned off (see FIG. 6).

Referring to FIG. 5, when the current is increased over the rated value, the temperature of the bimetal element 50 is relatively increased, causing the bimetal element 50 to trip off and to disconnect the circuit between the first metal contact plate 11 and the second metal contact plate 12, and therefore safety switch is switched off.

Referring to Figures from 3 through 5 again, during inspection, the adjustment screw 60 is rotated to adjust the oscillating angle of the movable member 40, enabling the trip-off time of the bimetal element 50 to be accurately controlled.

While only one embodiment of the present invention has been shown and described, it will be understood that various modifications and changes could be made thereunto without departing from the spirit and scope of the invention disclosed.

What the invention claimed is:

1. A safety switch comprising:

an electrically insulative housing, said housing having a closed bottom side and open top side;

a first metal contact plate, a second metal contact plate and a third metal contact plate respectively fastened to the closed bottom side of said housing, said second metal contact plate being spaced between said first metal contact plate and said third metal contact plate, said first metal contact plate having a contact at a top side thereof disposed inside said housing;

a lever pivotable in said housing and suspended in the open side of said housing via a pivot device that connects said lever to said housing;

a metal movable member connected to and pivotable on said second metal contact plate and suspended inside said housing;

a smoothly arched trip-off element having fixed and open ends, the trip-off element movable with the metal movable member to position the open end of the trip-off element to either attach or detach from the fist metal contact plate, the fixed end of said trip-off element fixedly connected to a first end of said metal movable member and the free end of the trip-off element comprises a contact, the contact of said trip-off element is contactable to said first metal contact plate;

an actuating member connected between said lever and said metal movable member and actuated by said lever to move said metal movable member on said second metal contact plate between a first position where said trip-off element is moved with said movable member to force the contact of said trip-off element into contact with said first metal contact plate, and a second position where said trip-off element is moved with said movable member to disconnect the contact of said trip-off element from said first metal contact plate;

wherein when said trip-off element is heated to trip off upon an overload after said metal movable member has been moved to said first position, causing said first metal contact plate to be electrically disconnected from said second metal contact plate; and the third metal contact plate is connectable to an optional light unit.

2. The safety switch of claim 1, wherein said actuating member is a spring.

3. The safety switch of claim 1, further comprising a stop member fixedly mounted inside said housing and disposed above the free end of said trip-off element to limit the rotation of said lever and said trip-off element.

4. The safety switch of claim 1, wherein said trip-off element is a bimetal element.

5. The safety switch of claim 1, further comprising an adjustment member mounted on the closed bottom side of said housing and positioned between said first metal contact plate and said second metal contact plate, the adjustment member configured for adjusting the rotation of said metal movable member on said second metal contact plate.

6. The safety switch of claim 5, wherein said adjustment member is an adjustment screw.

* * * * *